US010151539B2

(12) United States Patent
Kamps et al.

(10) Patent No.: US 10,151,539 B2
(45) Date of Patent: Dec. 11, 2018

(54) SELF-CONTAINED FLAMELESS HEAT TRANSFER FLUID HEATING SYSTEM

(71) Applicant: Multitek North America, LLC, Prentice, WI (US)

(72) Inventors: Douglas Kamps, Minocqua, WI (US); Timothy C. Stolar, Rhinelander, WI (US); Thomas J. Umlauf, Rhinelander, WI (US)

(73) Assignee: Multitek North America, LLC, Prentice, WI (US)

( * ) Notice: Subject to any disclaimer, the term of this patent is extended or adjusted under 35 U.S.C. 154(b) by 1363 days.

(21) Appl. No.: 13/754,279

(22) Filed: Jan. 30, 2013

(65) Prior Publication Data

US 2014/0209281 A1 Jul. 31, 2014

(51) Int. Cl.

| | |
|---|---|
| ***F28D 7/00*** | (2006.01) |
| ***F24H 1/06*** | (2006.01) |
| ***F28F 9/02*** | (2006.01) |
| ***F24D 11/00*** | (2006.01) |
| ***F24V 40/00*** | (2018.01) |

(52) U.S. Cl.

CPC ..... *F28D 7/00* (2013.01); *F24D 11/002* (2013.01); *F24H 1/06* (2013.01); *F24V 40/00* (2018.05); *F28F 9/0231* (2013.01); *F24H 2240/06* (2013.01)

(58) Field of Classification Search

CPC ..... F28D 7/00
USPC ..... 165/104.14; 237/56
See application file for complete search history.

(56) References Cited

U.S. PATENT DOCUMENTS

| | | | | |
|---|---|---|---|---|
| 4,728,029 A * | 3/1988 | Griebel | B60H 1/22 122/26 |
| 5,098,036 A * | 3/1992 | Brigham | B64F 5/23 122/26 |
| 5,181,655 A | 1/1993 | Bruckelmyer | |
| 5,222,696 A | 6/1993 | Brigham | |
| 5,279,262 A | 1/1994 | Muehleck | |
| 5,838,880 A | 11/1998 | Brooks, Jr. et al. | |

(Continued)

OTHER PUBLICATIONS

Flex Temp Systems, Fusion 4500.

(Continued)

*Primary Examiner* — Steven B McAllister
*Assistant Examiner* — John Bargero
(74) *Attorney, Agent, or Firm* — Andrus Intellectual Property Law, LLP

(57) ABSTRACT

A heating system for heating at least one of a fluid-filled conduit arrangement and a volume of air includes an internal combustion engine provided with engine coolant that flows to and from the engine and is heated thereby. A fluid heat exchanger is provided in fluid communication with a heat transfer fluid stored in a reservoir and the engine coolant of the internal combustion engine. The fluid heat exchanger receives heated engine coolant from the internal combustion engine, and transfers heat from the heated engine coolant to the heat transfer fluid to provide heated transfer fluid. A heat generator is provided in fluid communication with the fluid heat exchanger, and receives the heated transfer fluid from the fluid heat exchanger for further heating. This heated transfer fluid may then be selectively used to heat a conduit or a volume of air.

13 Claims, 16 Drawing Sheets

(56) References Cited

U.S. PATENT DOCUMENTS

| | | | | |
|---|---|---|---|---|
| 5,894,883 | A * | 4/1999 | Gentry | F28D 7/0066 165/159 |
| 5,964,402 | A | 10/1999 | Jakobson | |
| 6,761,135 | B1 * | 7/2004 | Becktold | B08B 3/026 122/396 |
| 7,441,986 | B2 | 10/2008 | Rottinghaus | |
| 7,614,367 | B1 * | 11/2009 | Frick | F22B 1/16 122/26 |
| 2004/0144200 | A1 | 7/2004 | Giordano et al. | |
| 2010/0000508 | A1 | 1/2010 | Chandler | |
| 2011/0005757 | A1 * | 1/2011 | Hebert | E21B 36/006 166/302 |
| 2011/0120427 | A1 | 5/2011 | Andersson | |
| 2011/0185713 | A1 | 8/2011 | Koopman et al. | |
| 2012/0048717 | A1 | 3/2012 | Frick | |
| 2012/0168126 | A1 * | 7/2012 | Tanaka | F28D 20/025 165/104.11 |
| 2012/0210953 | A1 * | 8/2012 | Cronin | F24J 3/003 123/2 |

OTHER PUBLICATIONS

Crown Construction Equipment, Heat King HK300 Mobile Glycol Heating System.
Flex Temp Systems, Fusion 4500, http://www.greenpowertechnology.com.

* cited by examiner

SELF-CONTAINED FLAMELESS HEAT TRANSFER FLUID HEATING SYSTEM

FIELD

The present disclosure relates generally to fluid heating systems and, more particularly, pertains to a self-contained, flameless mobile heating system for selectively heating a conduit arrangement and/or a volume of air using heated transfer fluid.

BACKGROUND

In northern climates, frozen ground is a problem for the construction industry during the winter months. Cold winter temperatures can cause water and sewer pipes to freeze. Frozen ground also interferes with any earth moving operation such as trenching, excavating for foundation footings, leveling for a concrete slab, or digging a gravesite. Further, after concrete footings and a slab are poured, there is a need for heat to properly cure the concrete. In instances where a building shell is erected, heat is needed to elevate temperatures within the unfinished structure for the protection of workmen and for curing or drying finishing processes that take place inside the building shell. Consequently, in cold climates, mobile heating systems for thawing, curing concrete and providing a temporary source of heated air are known. Current designs are unsatisfactory because of the inadequacy and cost of heating the ground or object surface or volume of air, as well as safety concerns.

Known mobile heating systems present imperfect solutions to the challenges of cold weather construction. Accordingly, construction in cold weather slows dramatically, creates increased hazards and costs and adds pressure on contractors to complete work in warmer weather. Given the large expanse of cold weather climates, improvements in coping with cold weather construction and providing an enhanced, more efficient mobile heating system are highly desirable.

SUMMARY

The present disclosure relates to a heating system including an internal combustion engine provided with engine coolant that flows to and from the engine and is heated thereby. A reservoir is provided containing a supply of heat transfer fluid. A fluid heat exchanger is in fluid communication with the heat transfer fluid of the reservoir and the engine coolant of the internal combustion engine receives heated engine coolant from the internal combustion engine, and transfers heat from the heated engine coolant to the heat transfer fluid. A heat generator in fluid communication with the fluid heat exchanger receives heated transfer fluid therefrom, and circulates the heated transfer fluid within the heat generator to directly heat the heated transfer fluid and allow for further heating of the heated transfer fluid.

The heating system may further comprise a pump for moving the heat transfer fluid from the reservoir through the fluid heat exchanger and the heat generator. In an exemplary embodiment, the pump is driven by the internal combustion engine and the fluid heat exchanger is a shell and tube heat exchanger. This fluid heat exchanger may have a first shell for holding a supply of engine coolant and a second shell in fluid communication with the first shell for interfacing heated engine coolant from the internal combustion engine with the heat transfer fluid from the reservoir to heat the transfer fluid and allow the cooled engine coolant to return to the internal combustion engine. The heat generator may include a control arrangement to allow for selectively using the heated transfer fluid to heat a conduit arrangement or a volume of air. The heat generator may further include a rotatable shaft having one end coupled to a driven engine crankshaft of the internal combustion engine and an opposite end of the shaft drivingly coupled to a blower arrangement. The heat generator may also include a rotor mounted on the shaft to circulate the heated transfer fluid within the heat generator causing fluid friction to create heat directly in the heated transfer fluid. The heat generator may be in fluid communication with a fluid to air heat exchanger for converting the heated transfer fluid to heated air. In one example, the fluid to heat air exchanger is a radiator. The heated air is drawn by a blower arrangement into an exhaust heat exchanger in communication with an air outlet. The heat generator may also be in fluid communication with a closed loop conduit connected to a hose reel arrangement. The internal combustion engine, the reservoir, the fluid heat exchanger, and the heat generator may be located on a mobile trailer provided with an enclosure, a set of ground engaging wheels and a hitching arrangement.

The present disclosure further relates to a heating system for heating at least one of a conduit arrangement and a volume of air, and includes an internal combustion engine provided with engine coolant that flows to and from the engine and is heated thereby. A reservoir contains a supply of heat transfer fluid, and a pump is provided in fluid communication with the reservoir for transferring the heat transfer fluid. A fluid heat exchanger is in fluid communication with the pump and the internal combustion engine and receives heated engine coolant from the internal combustion engine, and also transfers heat from the heated engine coolant to the heat transfer fluid to heat the transfer fluid, while allowing cooled engine coolant to return to the internal combustion engine. A heat generator is in fluid communication with the fluid heat exchanger for receiving the heated transfer fluid therefrom, and circulates the heated transfer fluid within the heat generator to create heat directly in the heated transfer fluid and cause further heating of the heated transfer fluid such that the heated transfer fluid selectively heats at least one of the conduit arrangement and the volume of air.

The present disclosure also relates to a mobile heating system including a mobile unit having an enclosure and a set of ground engaging wheels. An internal combustion engine mounted on the unit has engine coolant flowing to and from the engine and heated thereby. A reservoir mounted on the unit contains a supply of heat transfer fluid. A pump mounted on the unit is in fluid communication with the reservoir for transferring the heat transfer fluid. A fluid heat exchanger mounted on the unit is in fluid communication with the pump and the internal combustion engine for receiving heated engine coolant from the internal combustion engine, for transferring heat from the heated engine coolant to the heat transfer fluid to provide heated transfer fluid, and for allowing cooled engine coolant to return to the internal combustion engine. A heat generator mounted on the unit is in fluid communication with the fluid heat exchanger and receives the heated transfer fluid therefrom, and circulates the heated transfer fluid within the heat generator to directly heat the heated transfer fluid and allow for further heating of the heated transfer fluid.

In the mobile heating system, the enclosure covers the internal combustion engine, the reservoir, the pump, the fluid heat exchanger and the heat generator. The mobile heating system may further include a radiator in fluid communication with the heat generator, and a rotatable hose reel provided with a closed loop conduit in fluid communication with the heat generator. The radiator and the hose reel may be mounted on the unit within the enclosure. The heat generator may include a three-way valve for selectively controlling flow of the heated transfer fluid from the heat generator to one of the radiator, the conduit and the combination of the radiator and the conduit. The enclosure may define an interior operating space that includes a set of doors for enabling access thereto, and an air outlet formed therethrough for providing a volume of heated air. The radiator is in communication with an air inlet at a rear end of the enclosure, and the hose reel is accessible from a front end of the enclosure. The enclosure may include a main deck for mounting the internal combustion engine, the reservoir, the pump, the fluid heat exchanger and the heat generator; and an understructure beneath the main deck for holding storage items and a fuel tank for the internal combustion engine.

The present disclosure additionally relates to a heating system having an internal combustion engine provided with engine coolant flowing to and from the engine and heated thereby. A reservoir containing a supply of heat transfer fluid, and a pump driven by the internal combustion engine are in fluid communication for transferring heat transfer fluid. A dual fluid heat exchanger is in fluid communication with the pump and the internal combustion engine for receiving heated engine coolant from the internal combustion engine, for transferring heat from the heated engine coolant to the heat transfer fluid to provide heated transfer fluid, and for allowing cooled engine coolant to return to the internal combustion engine. A heat generator, driven by the internal combustion engine, is in fluid communication with the fluid heat exchanger and receives the heated transfer fluid therefrom, and also circulates the heated transfer fluid within the heat generator to directly heat the transfer fluid and also allow for further heating of the heated transfer fluid. A radiator and a conduit arrangement are also in fluid communication with the heat generator. The heated transfer fluid from the heat generator is selectively delivered to at least one of the radiator and the conduit arrangement.

BRIEF DESCRIPTION OF THE DRAWINGS

The best mode of carrying out the disclosure is described herein below with reference to the following drawing figures.

DETAILED DESCRIPTION

Figure 1:
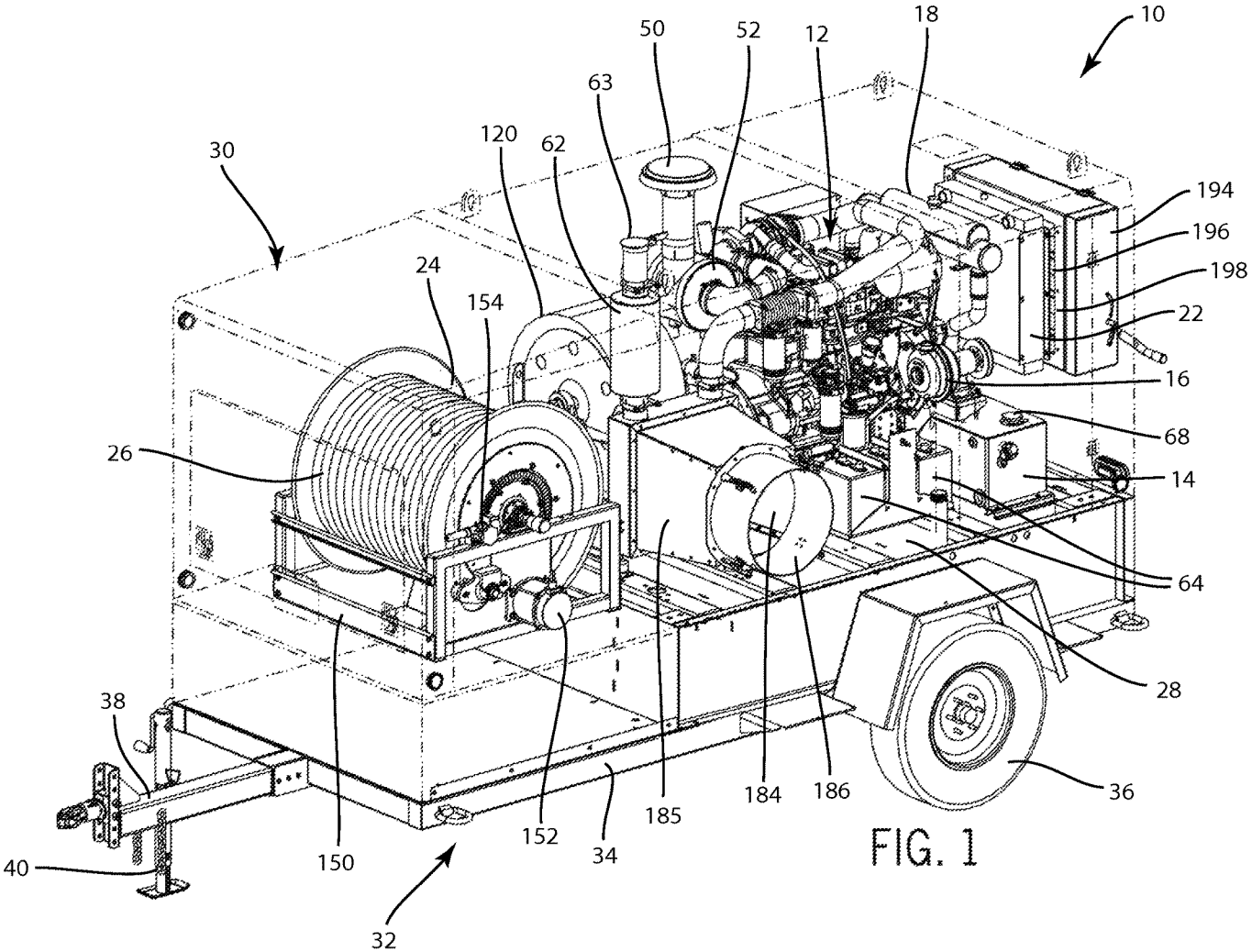
FIG. 1 is a partially transparent, perspective view of a self-contained, flameless heat transfer fluid heating system in accordance with the present disclosure.

Referring now to FIGS. 1-5, thereshown is an embodiment of a self-contained, flameless heat transfer fluid heating system 10 in accordance with the present disclosure. In the embodiment shown in the drawings, the heating system 10 is a mobile trailer-based heater that circulates and heats a supply of heat transfer fluid in a closed loop. In an exemplary application, the heating system 10 is designed for cold weather use in thawing frozen ground and other surfaces or for concrete curing, or to supply temporary heated air, such as on construction sites, for disaster recovery, or drying of various objects.

The heating system 10 is generally comprised of a group of main operating components including an internal combustion engine 12, a heat transfer fluid reservoir 14, a centrifugal pump 16, a fluid heat exchanger 18, a dynamic heat generator 20, a fluid to air heat exchanger 22 and a rotatable reel 24 provided with a closed loop conduit arrangement 26 spooled thereon. As will be further described hereafter, in this embodiment, the main operating components of the heating system 10 are protectively housed and variously supported on a main deck 28 or surrounding wall structure 30 defining an enclosure mounted on a mobile unit in the form of a trailer 32 designed to be transported by a towing vehicle. The trailer 32 has a framework 34 provided with a set of ground engaging wheels 36 and a hitching apparatus 38 including at least one supporting jack 40. It should be understood that the trailer 32 may suitably be replaced by a self-propelled mobile vehicle housing the main operating components of the heating system 10, and that the mobile unit may take other configuration to allow the heating system 10 to be transported.

Figure 5:
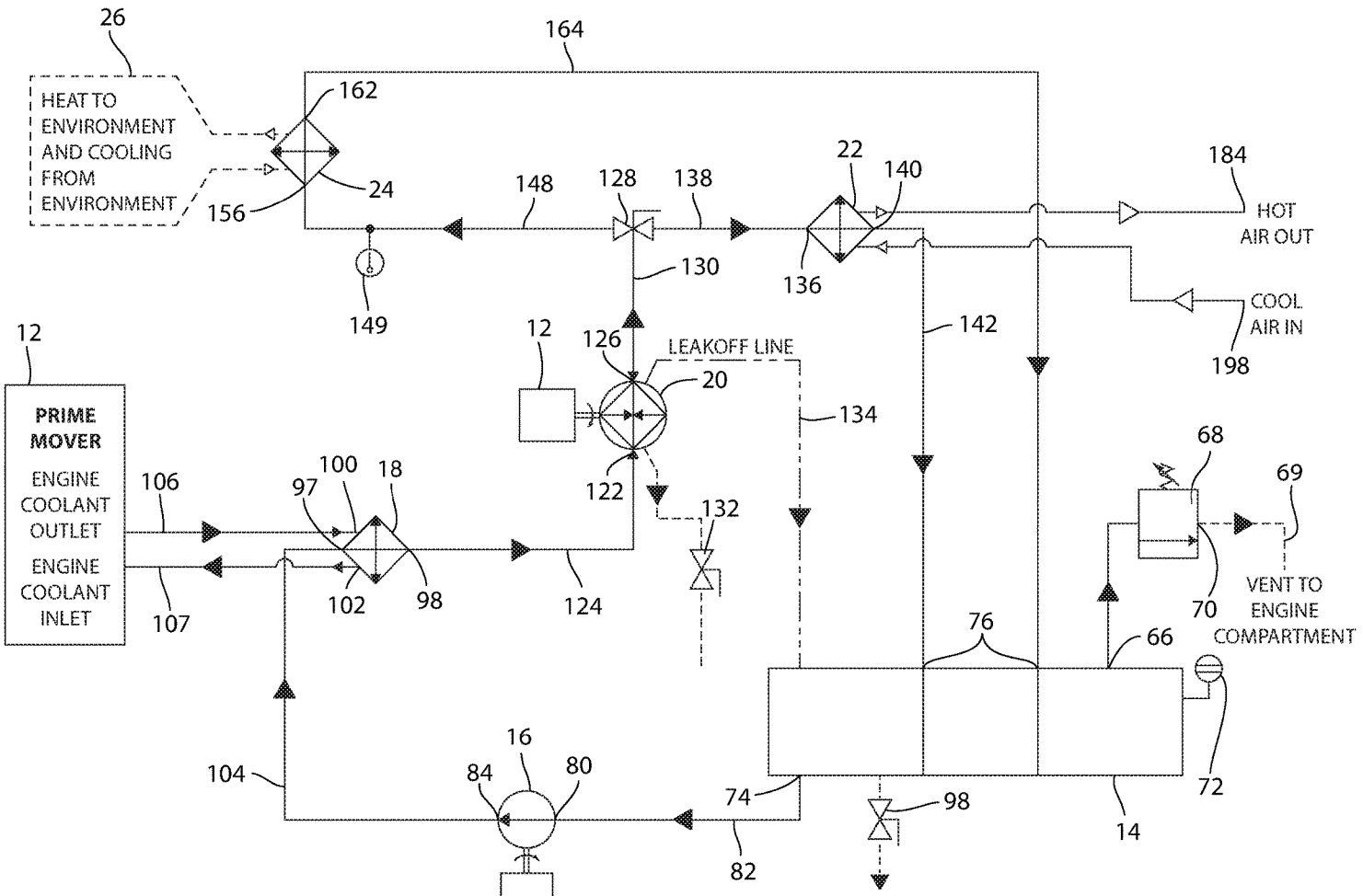
FIG. 5 is a schematic diagram of the heating system of FIG. 1.

In the description to follow, FIGS. 1-4 illustrate the physical relationship and proximity of the main operating components. FIG. 5 depicts the schematic interconnection of the main operating components. FIGS. 6-13 show isolated views of the main components, and FIGS. 14-16 reveal details of the mobile mounting of the heating system 10.

Figure 2:
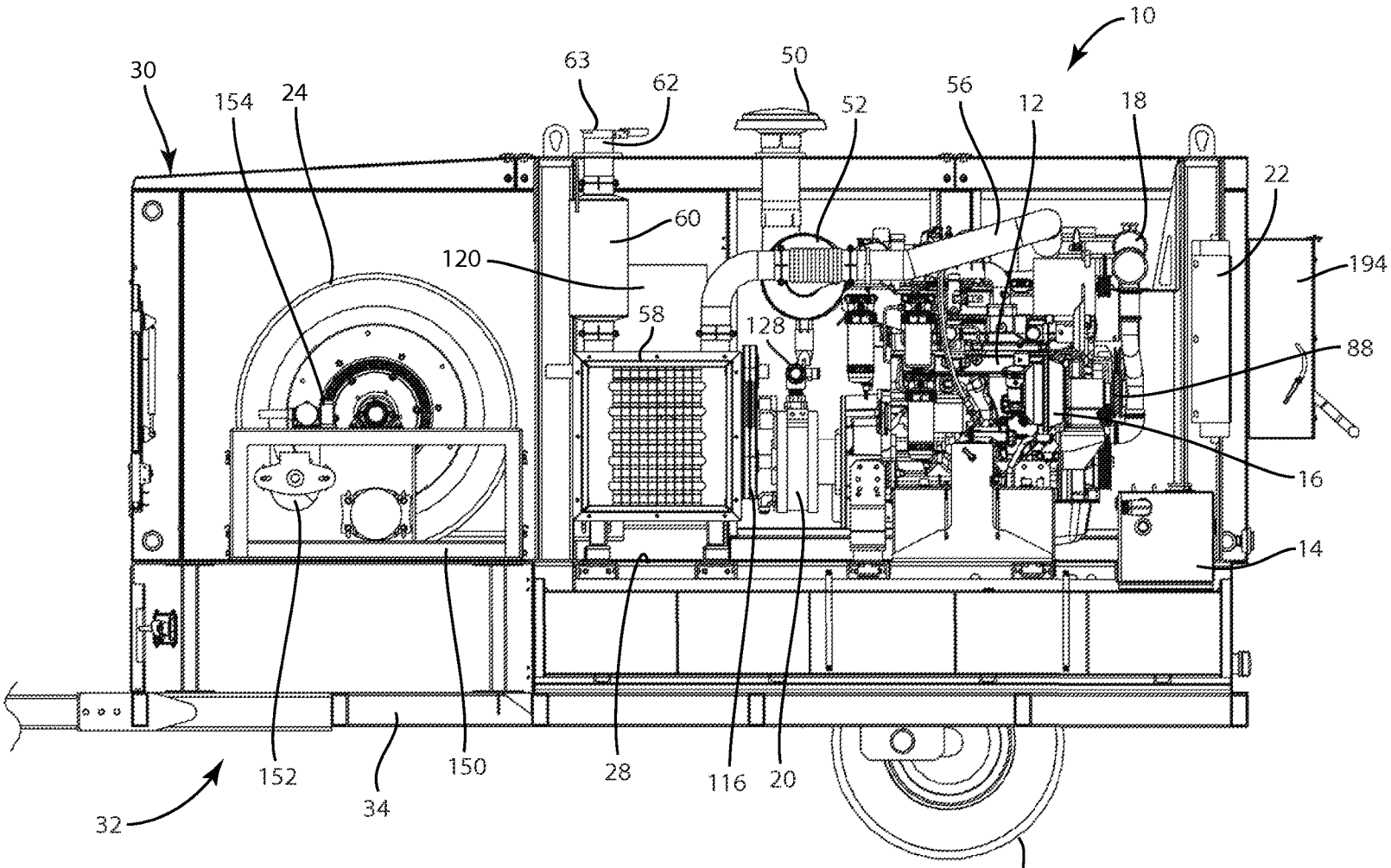
FIG. 2 is a vertical sectional view of the heating system taken from the left side of FIG. 1.
Figure 6:
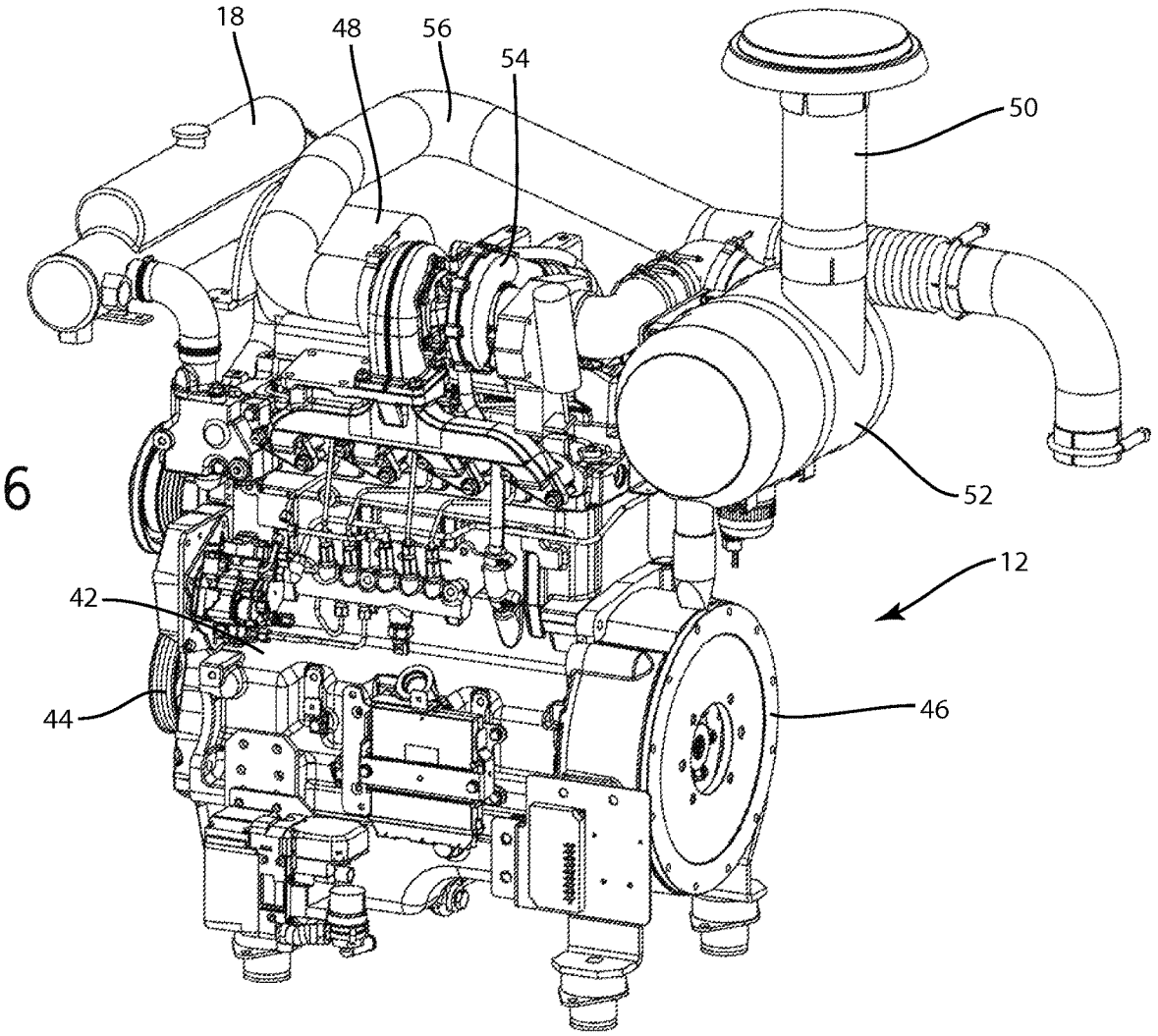
FIG. 6 is a perspective view of an internal combustion engine and shell and tube heat exchanger used in the heating system.
Figure 7A:
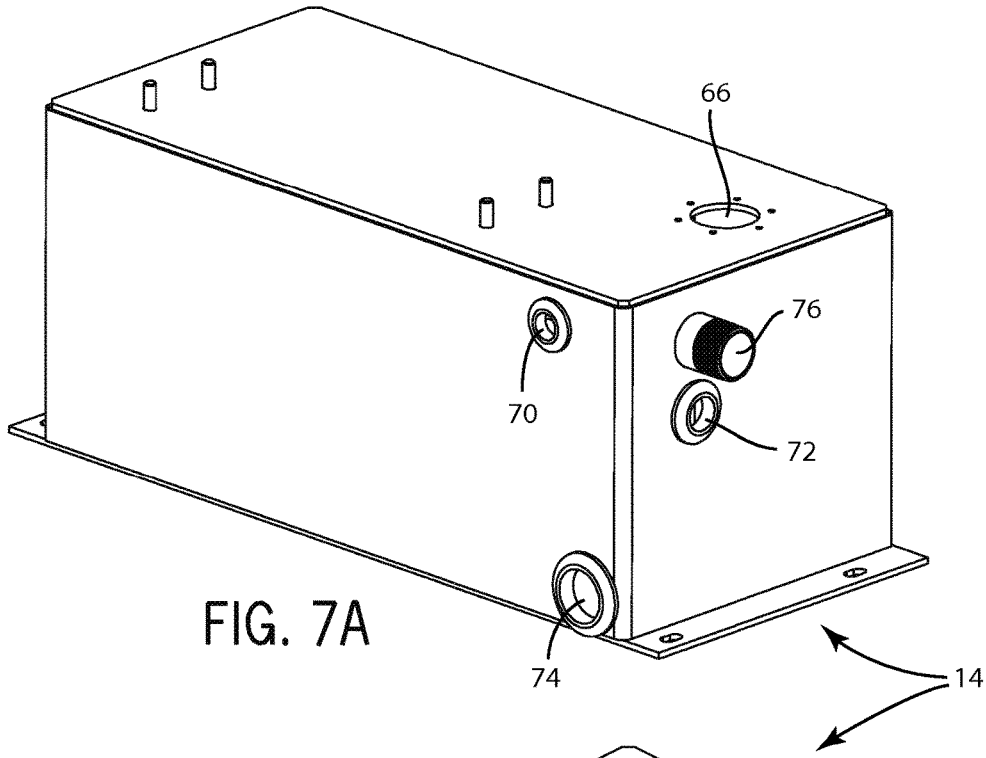
FIGS. 7A and 7B are perspective views of a reservoir used in the heating system.
Figure 7B:
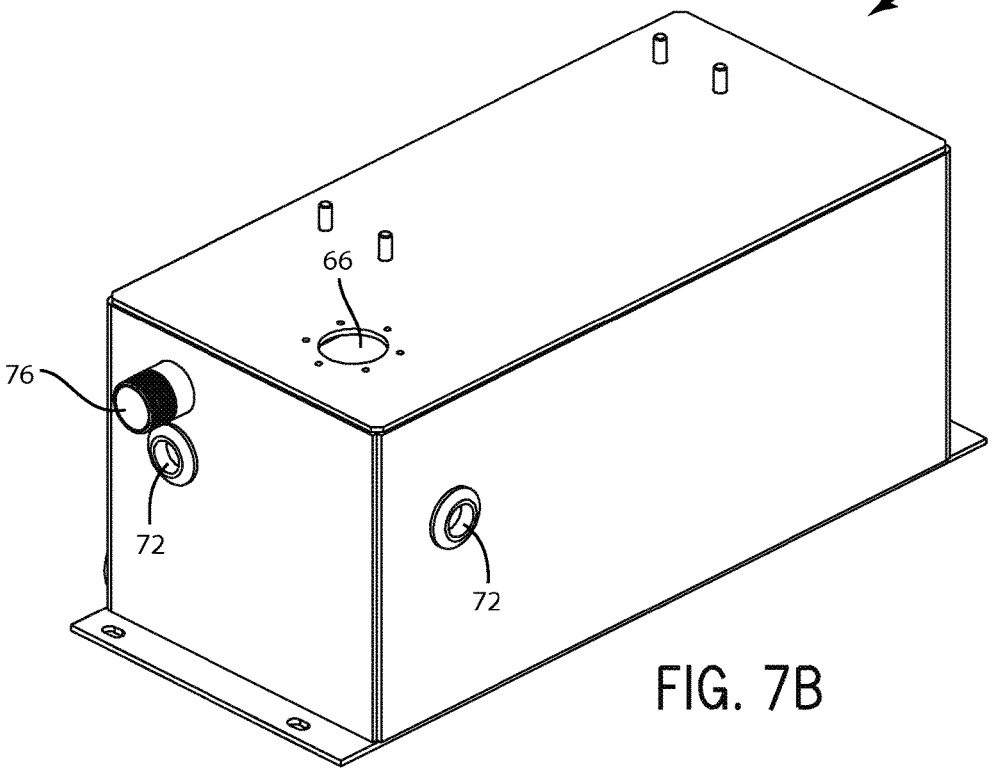

The internal combustion engine 12 drives the heating system 10 and is preferably embodied in a diesel engine, such as represented in the isolated view of FIG. 6. The diesel engine 12 is suitably supported on the main deck 28 of the trailer 32, and is constructed with typical components that are necessary to facilitate prime mover operation. These engine components include an engine block 42 having a driven rotatable crankshaft, a crankshaft pulley 44, a flywheel 46, an alternator 48, an air intake assembly 50, an air cleaner 52, a turbo 54 and an exhaust pipe 56. With reference to FIG. 2, the exhaust pipe 56 is routed through an exhaust heat exchanger 58 mounted on the main deck 28, and connected to a muffler 60 having an exhaust outlet 62 so that exhaust gas from engine 12 is discharged outside the top of enclosure 30. The outlet 62 is covered with a protective movable rain cap 63 that normally permits the opening of the outlet 62 in the presence of exhaust gas flow, and closes to prevent entry of precipitation and other foreign items when there is no exhaust gas flow. The internal combustion engine 12 operates at high temperatures and thus requires continuous or intermittent cooling during operation to prevent thermal breakdown and to increase efficiency. Accordingly, as is well known, the engine 12 also typically includes a water jacket having an inlet and an outlet to allow engine coolant, such as a liquid antifreeze and water solution, to be pumped therethrough. As will be further explained below, the water jacket is operably connected to the heat exchanger 18. An electrical source for actuating the engine 12 and providing auxiliary power is provided by a set of batteries 64 mounted on the trailer main deck 28 as seen best in FIGS. 2 and 4. Other well-known engine related components such as filters, pumps, pulleys, and belts are not specifically identified in FIG. 6, but the scope and content of these components are known to one skilled in the art. It should be understood that other internal combustion engines may be used for powering the heating system 10.

The heat transfer fluid reservoir 14 is mounted on the trailer main deck 28 at a rearward end thereof, and is constructed to hold a supply of heat transfer fluid, such as propylene glycol liquid, at an ambient temperature. As seen best in FIGS. 7A and 7B, the reservoir 14 has a top wall that includes a fill port 66 that is normally held closed by a pressure cap 68 (FIG. 1) vented into the enclosure 30 as represented by a conduit 69 (FIG. 5). The reservoir 14 also includes side wall structure provided with a vent port 70, sight glass ports 72 for monitoring the level of glycol within the reservoir 14, a supply outlet 74 in fluid communication with the pump 16, and a return inlet 76 in fluid communication with the fluid to air heat exchanger 22 and the hose reel 24 with its conduit arrangement 26. In addition, the reservoir 14 is provided with a drain valve 78 as shown in FIG. 5.

Figure 8:
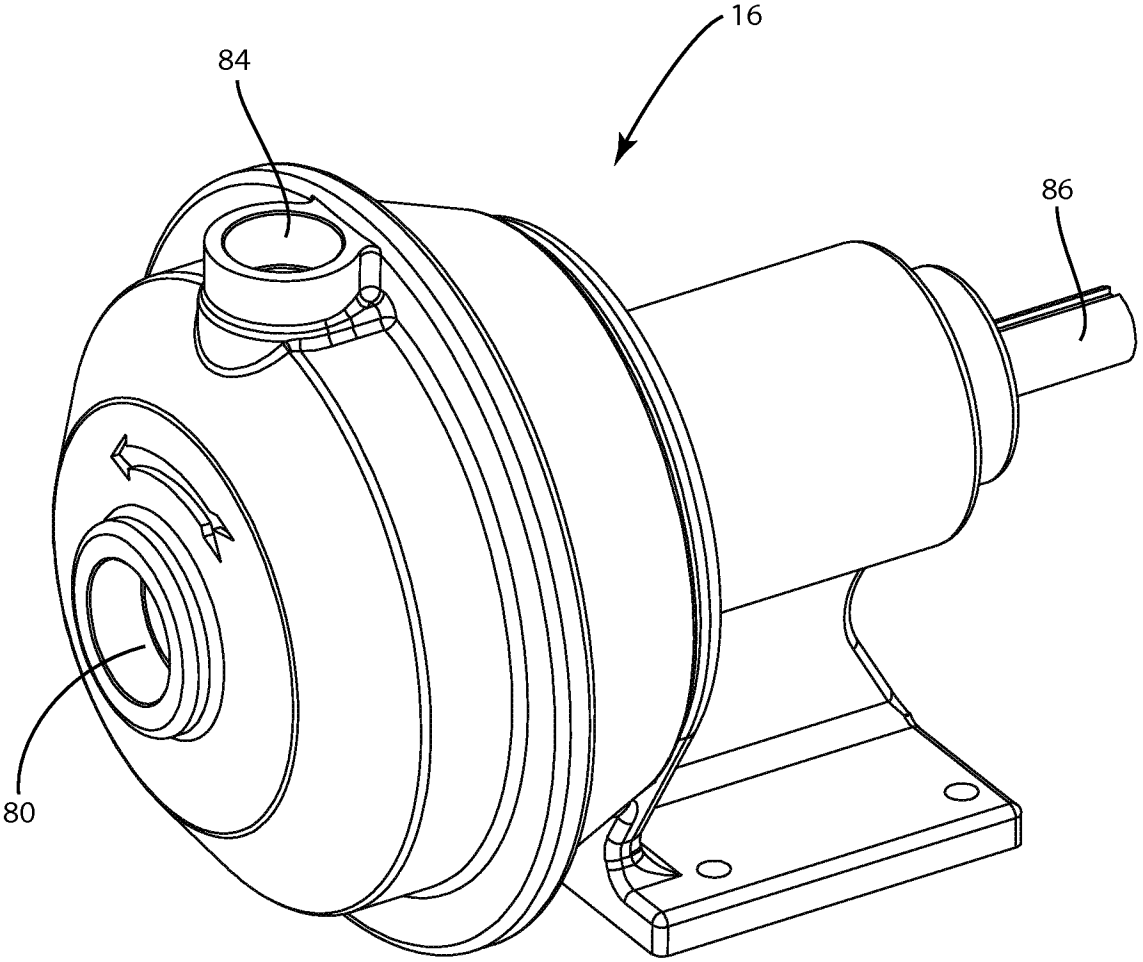
FIG. 8 is a perspective view of a pump used in the heating system.

The pump 16 is supported adjacent the engine 12 and, as seen in FIG. 8, has one end formed with an inlet 80 that is interconnected by a conduit represented at 82 (FIG. 5) with the supply outlet 74 of the reservoir 14. A top portion of the pump 16 is designed with an outlet 84 in fluid communication with the fluid heat exchanger 18. The pump 16 also has a rotatable shaft 86 opposite inlet 80 that carries a pulley 88 (FIG. 2) that is belt driven by the engine 12 to move pressurized heat transfer fluid, such as glycol, from the reservoir 14 through the outlet 84 to the heat exchanger 18 and the remainder of system 10.

Figure 9:
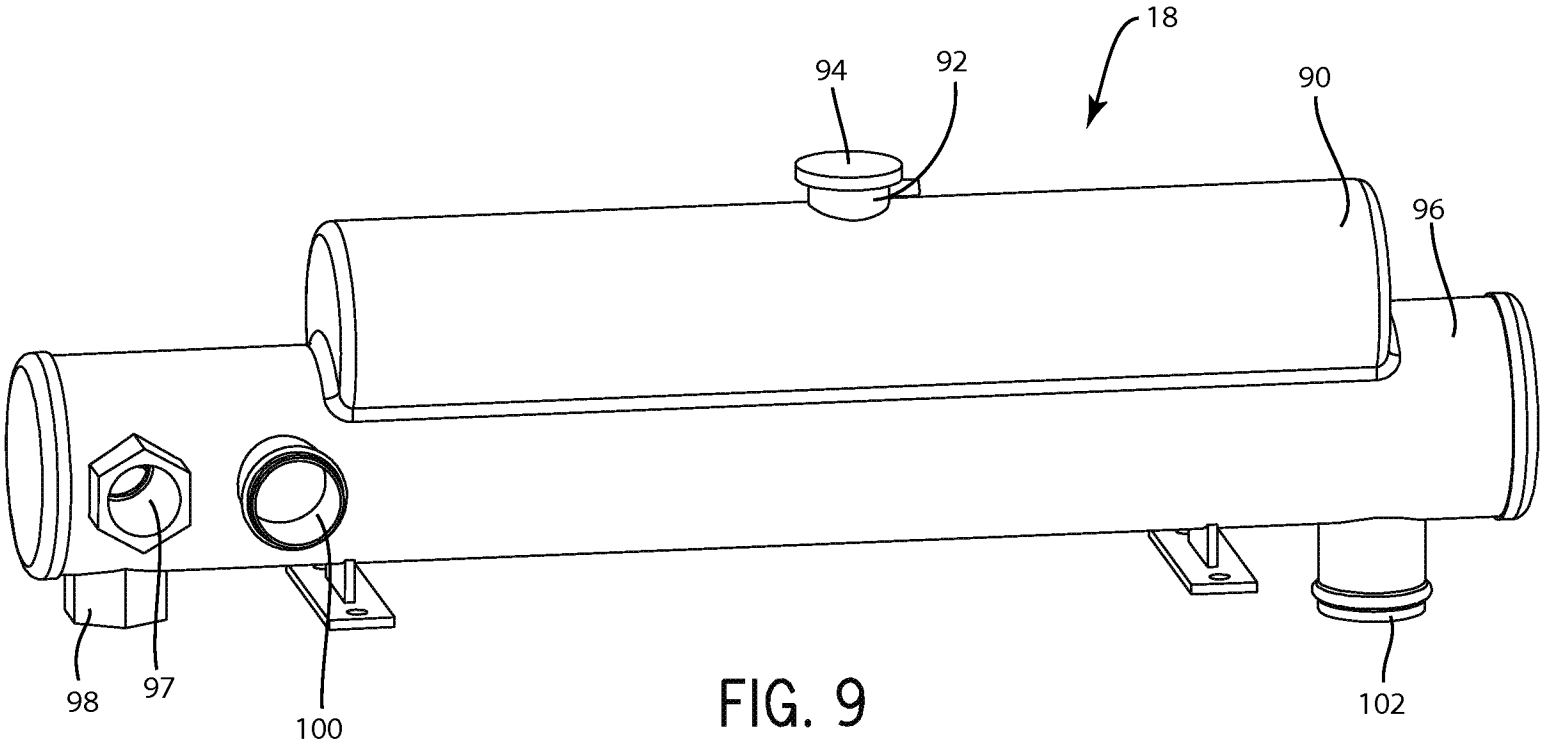
FIG. 9 is a perspective view of the shell and tube heat exchanger used in the heating system.

The fluid heat exchanger 18 is mounted on a bracket supported from the trailer enclosure 30, and, in the depicted embodiment, takes the form of a shell and tube heat exchanger in fluid communication with both the internal combustion engine 12 and the pump 16. As best represented in FIG. 9, the heat exchanger 18 has a first shell 90 designed to hold engine coolant therein and to function as an expansion tank. The first shell 90 is constructed with a fill port 92 that is normally closed by a vented pressure cap 94. The heat exchanger 18 has a second shell 96 joined and in fluid communication with the first shell 90, and having a heat transfer fluid inlet 97, a heat transfer fluid outlet 98, an engine coolant inlet 100 and an engine coolant outlet 102. The heat transfer fluid inlet 97 is interconnected by a conduit represented at 104 (FIG. 5) with the pump outlet 84, and the heat transfer fluid outlet 98 is in fluid communication with the dynamic heat generator 20. The engine coolant inlet 100 and outlet 102 of the heat exchanger 18 are interconnected by a conduit arrangement 106, 107 with the outlet and inlet, respectively, of the engine water jacket in which the engine coolant is normally heated by operation of the engine 12.

As is well known with shell and tube heat exchangers, the interior of second shell 96 contains a tubular structure through which the heat transfer fluid at ambient temperature flows. The heated engine coolant from the engine water jacket interfaces or flows in the shell 96 around the tubular structure carrying the heated engine coolant so that heat is exchanged between the heated engine coolant and the heat transfer fluid at ambient temperature. The first shell 90 provides an area within which the heated engine coolant can expand as the system cycles thermally in order to prevent thermal deformation of the heat exchanger 18. As a result, the heat exchanger 18 functions to transfer heat from the heated engine coolant to the heat transfer fluid at ambient temperature so that a supply of initially heated transfer fluid is delivered to the heat generator 20. At the same time, cooled engine coolant is returned to the water jacket of the engine 12. Because the heat transfer fluid is heated and the engine coolant cooled, the heat exchanger 18 may be described as a dual fluid heat exchanger.

Figure 3:
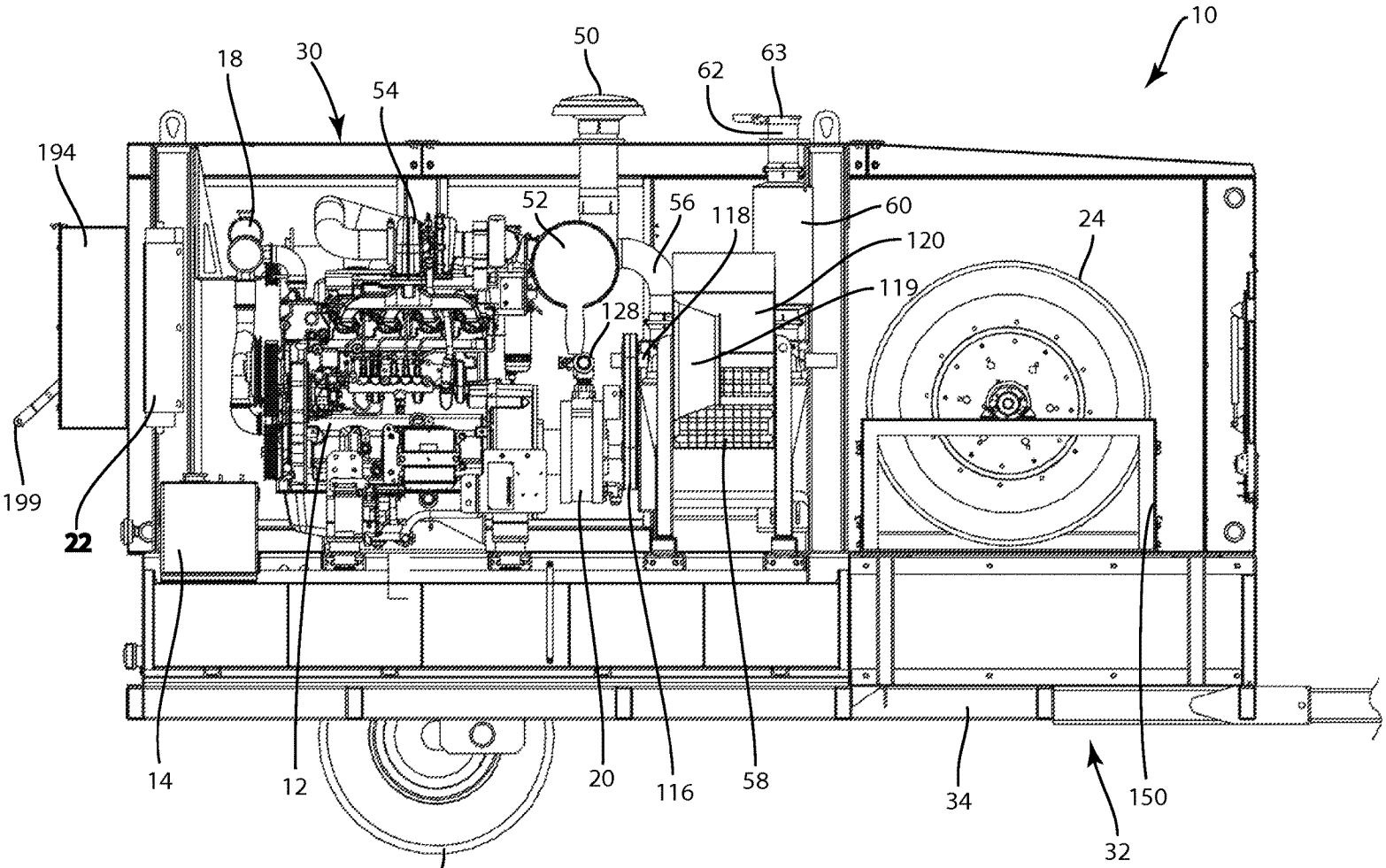
FIG. 3 is a vertical sectional view of the heating system taken from the right side of FIG. 1.
Figure 4:
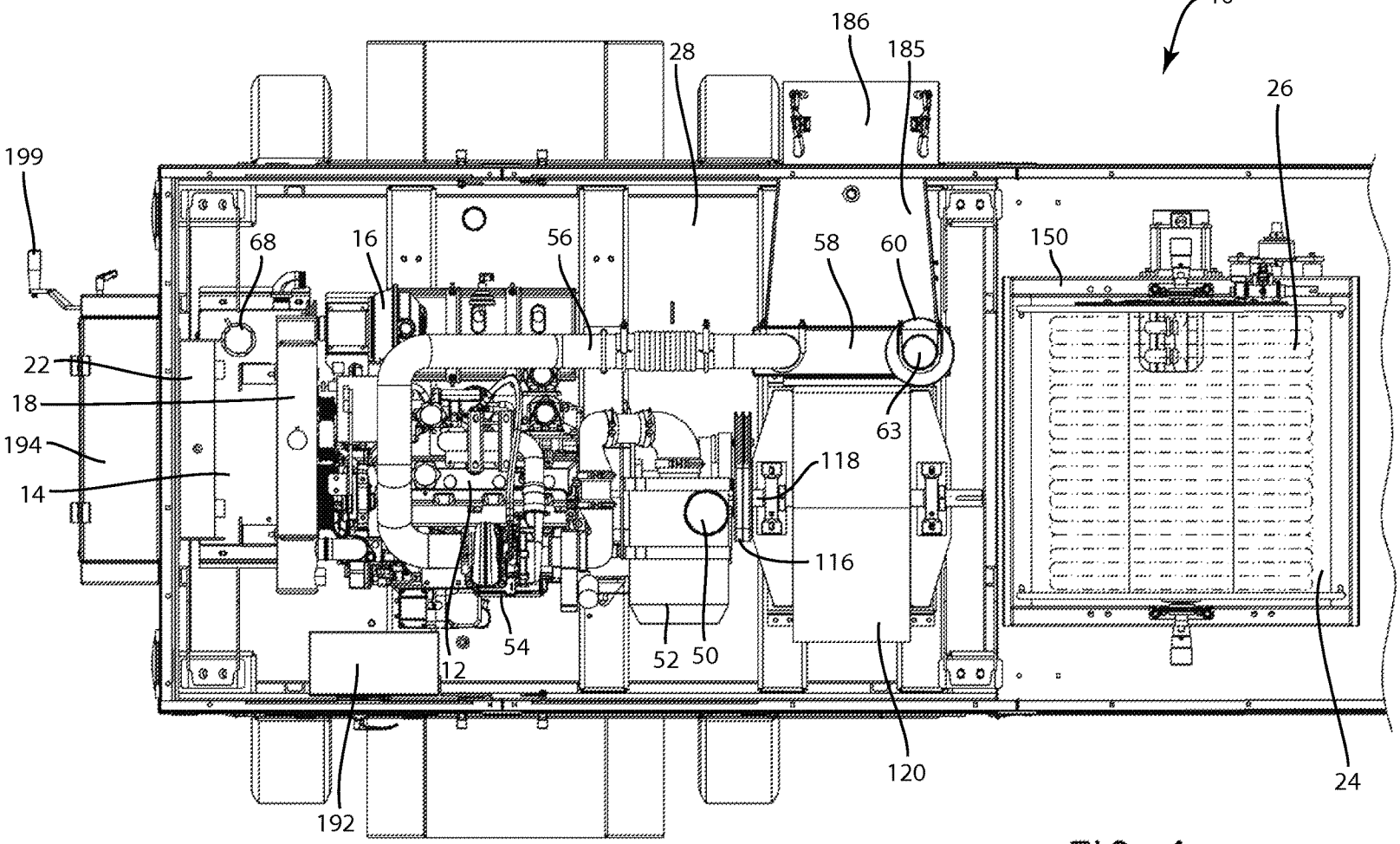
FIG. 4 is a top view of the heating system of FIG. 1.
Figure 10:
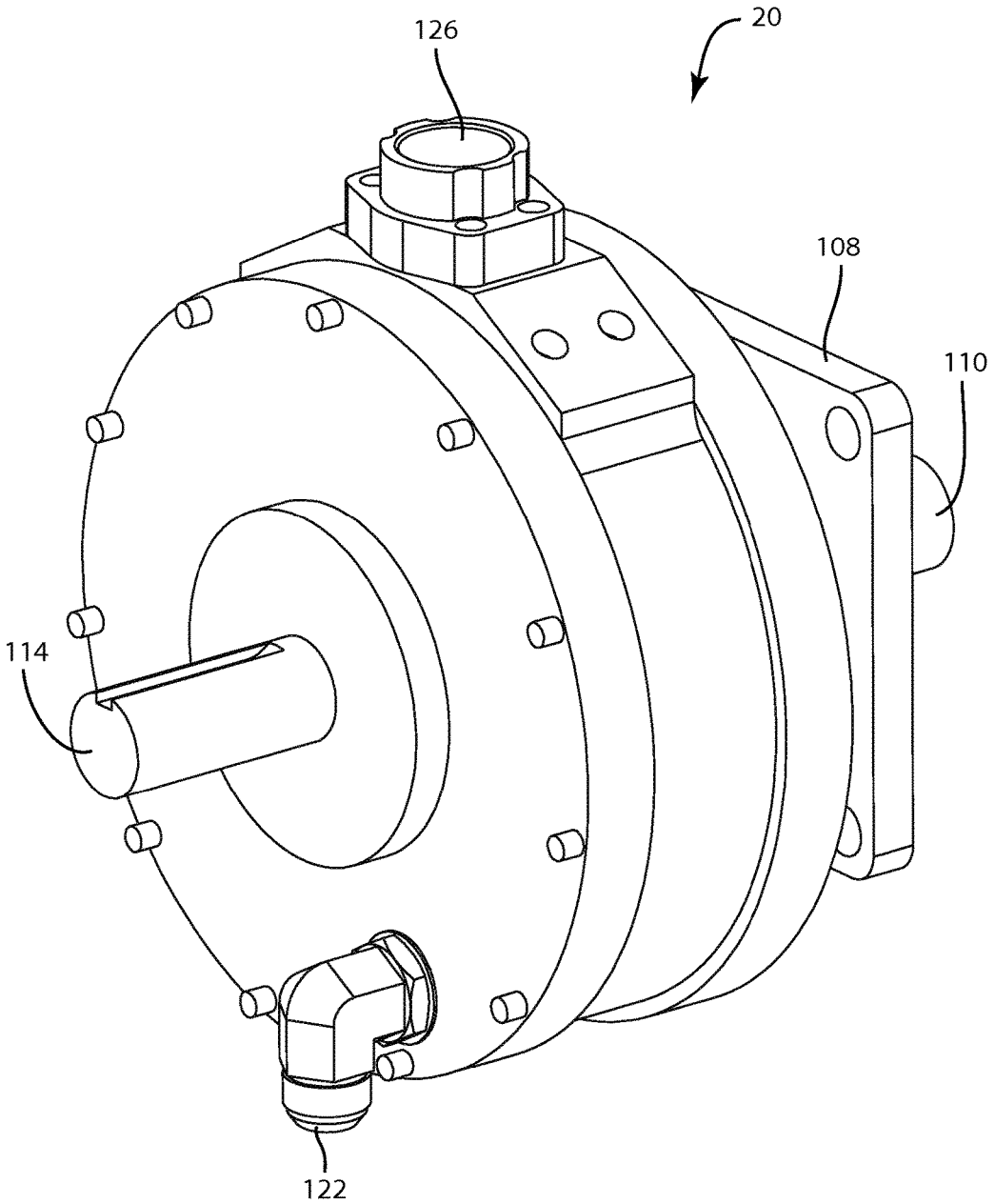
FIG. 10 is a perspective view of a heat generator used in the heating system.
Figure 11:
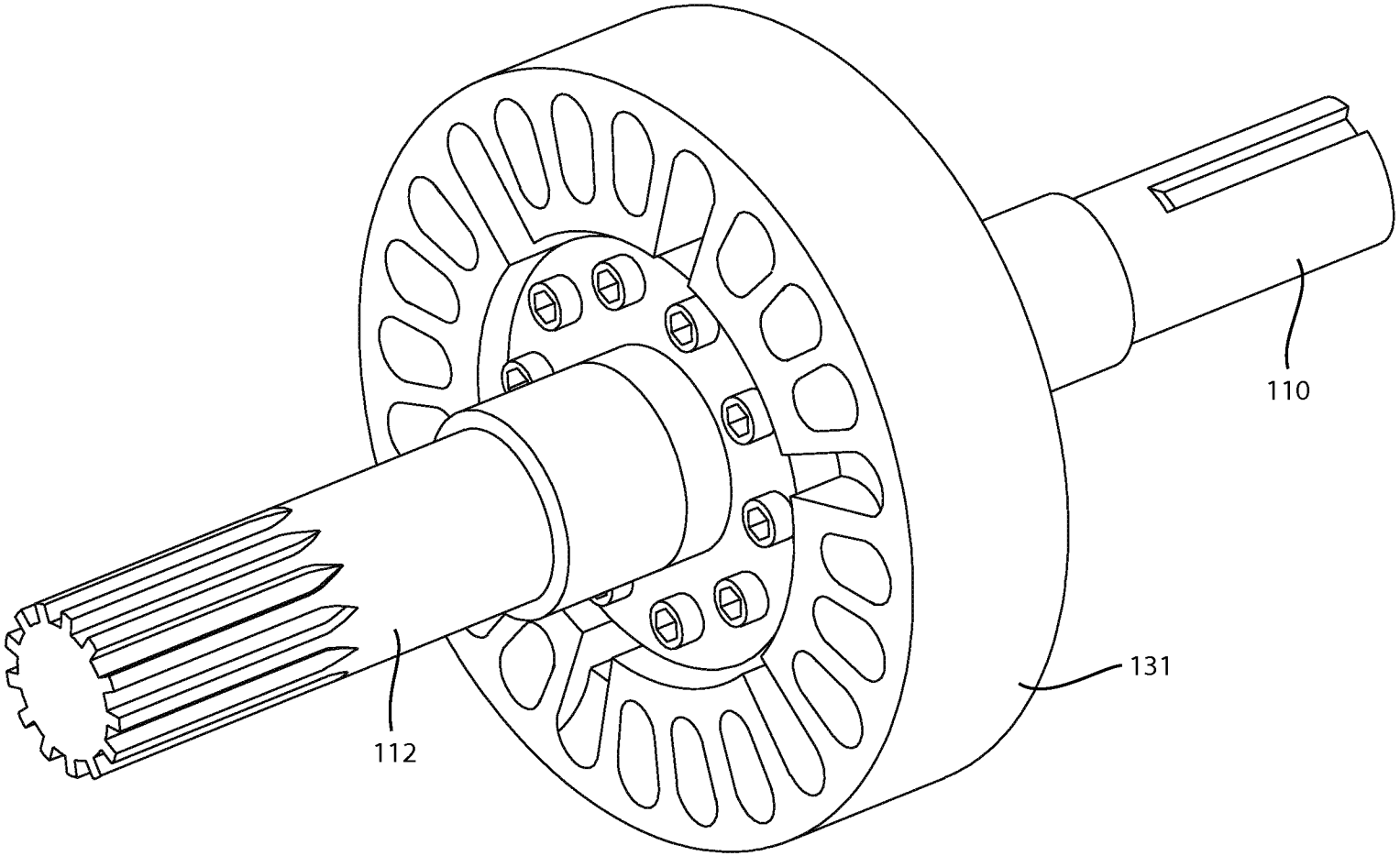
FIG. 11 is an isolated perspective view of a rotor and shaft used in the heat generator at FIG. 10.

Referring to FIGS. 2, 3 and 10, the dynamic heat generator 20 is a mechanically driven fluid heater which uses rotary shaft input to instantaneously and directly heat fluids received within the heat generator without a heat exchanger. In the exemplary embodiment, the heat generator 20 is a commercially available product supplied by Island City, LLC of Merrill, Wis. The dynamic heat generator 20 includes a mounting plate assembly 108 which is coupled to the rotatable flywheel 46 of the engine 12 so as to rotate an inlet end 110 of a drive shaft 112 associated with the mounting plate 108. An outlet end 114 of the rotatable drive shaft 112 carries a belt and pulley arrangement 116 which transfers rotation to a pulley fixed on an end of a shaft 118 that mounts a fan 119 (FIG. 3) within a blower arrangement 120. The heat generator 20 has an inlet 122 that is interconnected by means of a conduit represented at 124 (FIG. 5) with the heat transfer outlet 98 of the heat exchanger 18. The heat generator 20 further has an outlet 126 that is in fluid communication with a three-way valve 128 by means of a conduit represented at 130 in FIG. 5.

Heated transfer fluid, such as glycol, supplied by heat exchanger 18 to the inlet 122 is mechanically driven by a rotor 131 (FIG. 11) mounted on the drive shaft 112 inside a housing of the heat generator 20. This results in circulation that causes fluid friction creating further heat in the heated transfer fluid so that the fluid temperature of the glycol increases to about 215° F. As depicted in the schematic of FIG. 5, a drain valve 132 is provided for emptying the heat generator 20, and a leak off conduit represented at 134 receives amounts of any heated transfer fluid which may leak past internal seals and bearings of the heat generator 20 in the event of failure of those bearings and seals. Any leak off fluid is then returned via conduit 134 to the reservoir 14.

Figure 12:
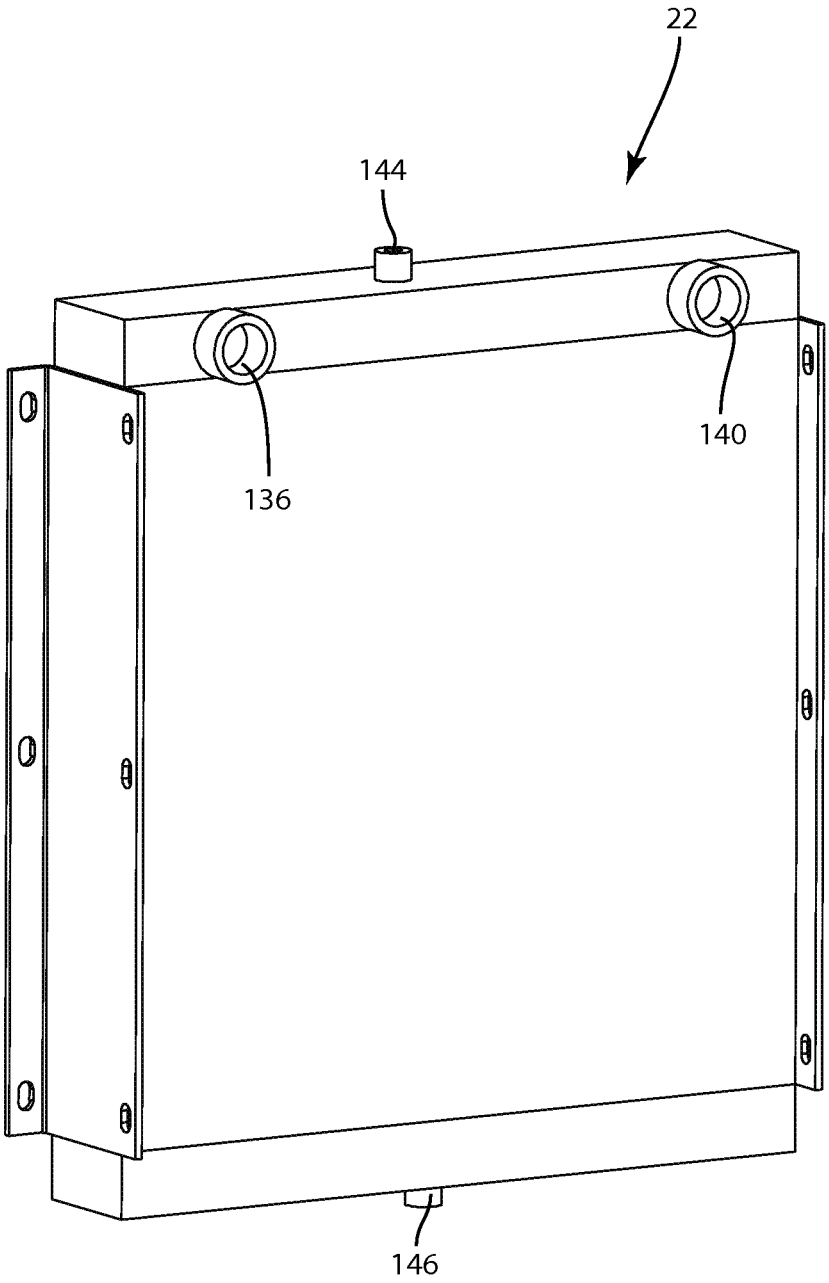
FIG. 12 is a perspective view of a radiator used in the heating system.

With further reference to FIG. 5, the three-way valve 128 at the outlet 126 of the heat generator 20 defines a control arrangement for selectively regulating the flow of heated transfer fluid through the system 10. The valve 128 is in fluid communication with the fluid to air heat exchanger 22. In the example shown, the heat exchanger 22 takes the form of a liquid to air heat exchanger, such as a radiator, that may be mounted at the rear of the trailer enclosure 30. As seen in FIG. 12, the radiator 22 includes an inlet 136 in fluid communication with valve 128 by means of a conduit represented at 138 in FIG. 5. An outlet 140 on the radiator 22 is in fluid communication with the reservoir 14 by means of a conduit represented at 142. A vent port 144 is provided at the top of the radiator 22, and a drain port 146 provided on the bottom thereof.

Figure 13:
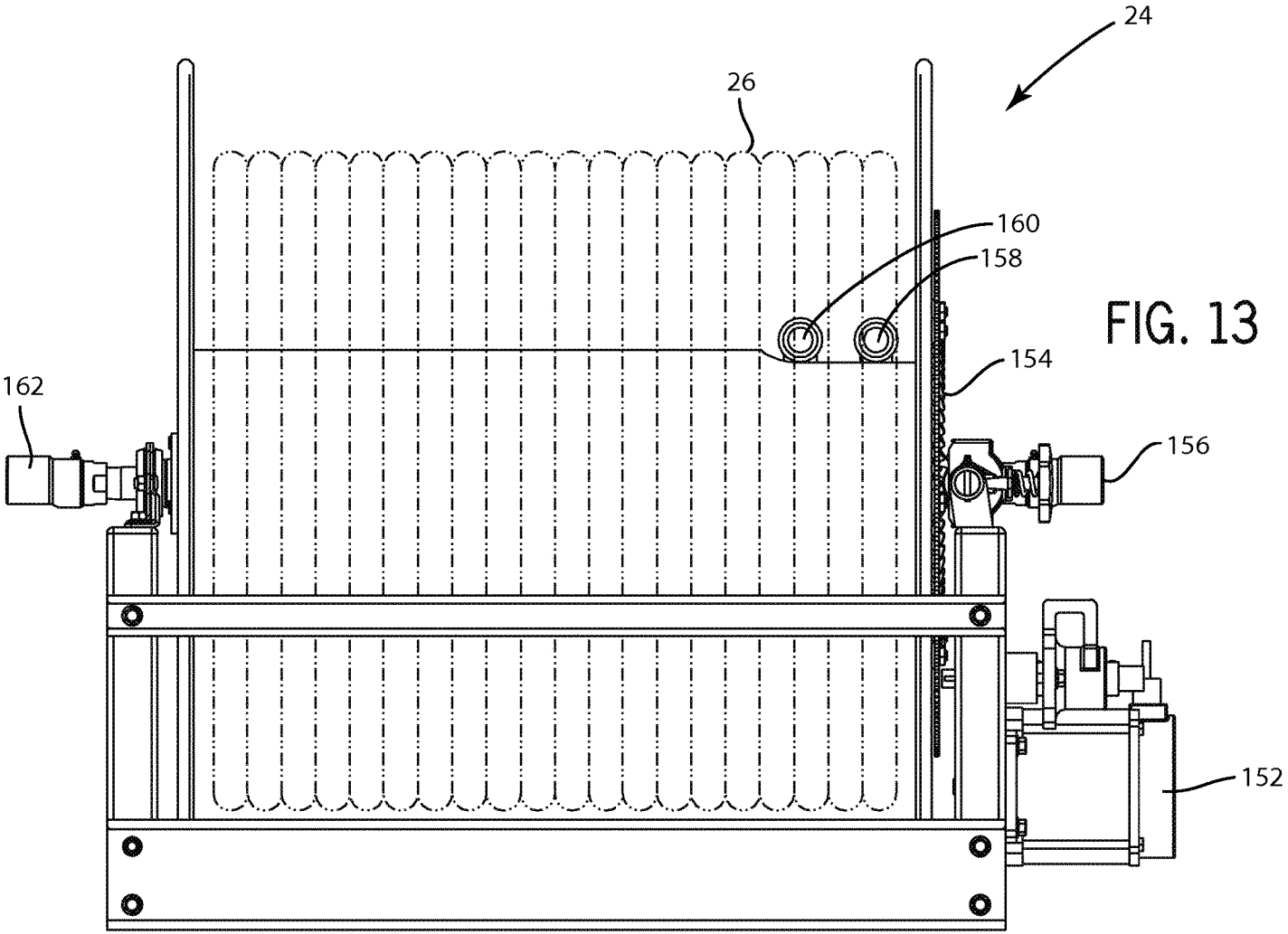
FIG. 13 is a front view of a hose reel used in the heating system.

The valve 128 is also in fluid communication with the hose reel 24 by means of a conduit represented at 148 in FIG. 5. Conduit 148 is provided with a temperature sensor 149 for monitoring the temperature of the heated glycol being sent from the heat generator 20. The hose reel 24 is rotatably mounted on a support structure 150 provided on the main deck 28 at a front end of the trailer 32. The hose reel 24 carries the closed loop conduit arrangement 26, and may be driven, for example by a motor 152 and intermeshing gear arrangement 154 seen in FIGS. 1 and 2, to automatically extend and retract the conduit arrangement 26 relative to the hose reel 24. Although not shown, a crank or handle may be provided on hose reel 24 for manually controlling winding and unwinding of the conduit arrangement 26. As seen in FIG. 13, the hose reel 24 includes a fluid inlet 156 in fluid communication with the valve 128 by means of the conduit 148. Fluid inlet 156 is in fluid communication with a supply port 158 on the hose reel 24 as well as an inlet to the closed loop conduit arrangement 26. An outlet of the closed loop conduit arrangement 26 is in fluid communication with a return port 160 and a fluid outlet 162 on the hose reel 24. The fluid outlet 162 is in fluid communication with the reservoir 14 by means of a return conduit represented in FIG. 5 at 164.

Figure 14:
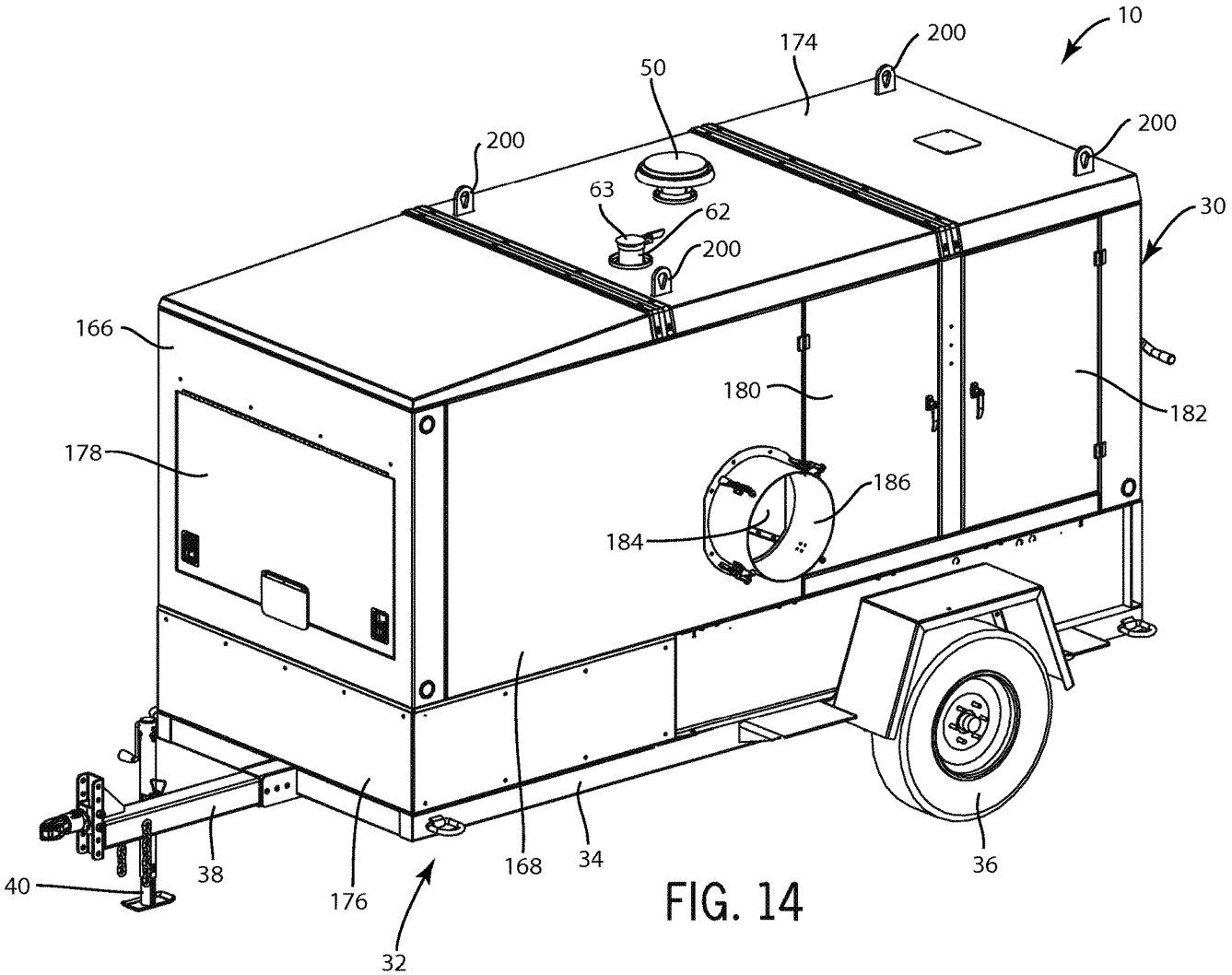
FIG. 14 is a left-side perspective view of the heating system similar to FIG. 1.
Figure 15:
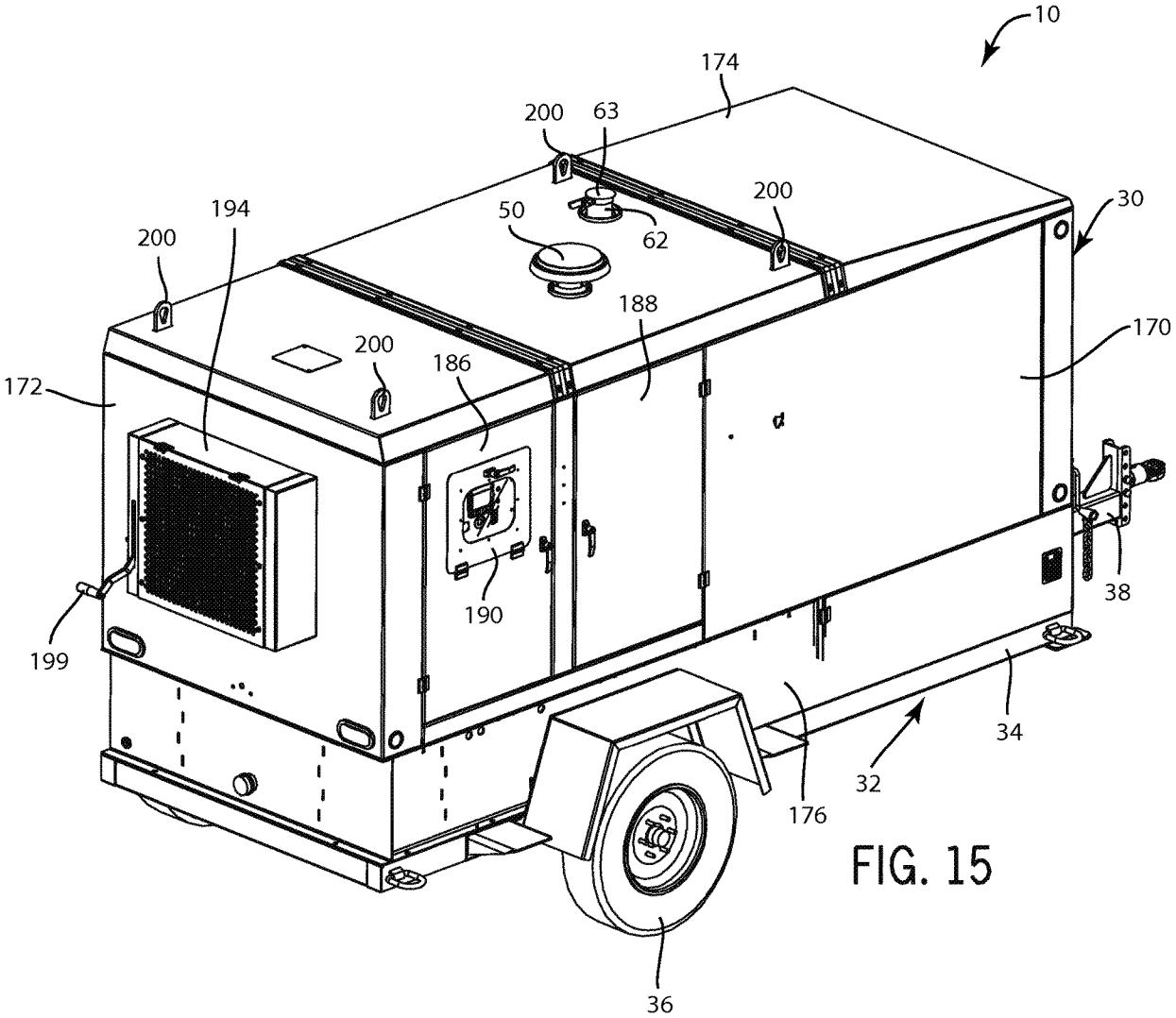
FIG. 15 is a right-side perspective view of the heating system of FIG. 1.
Figure 16:
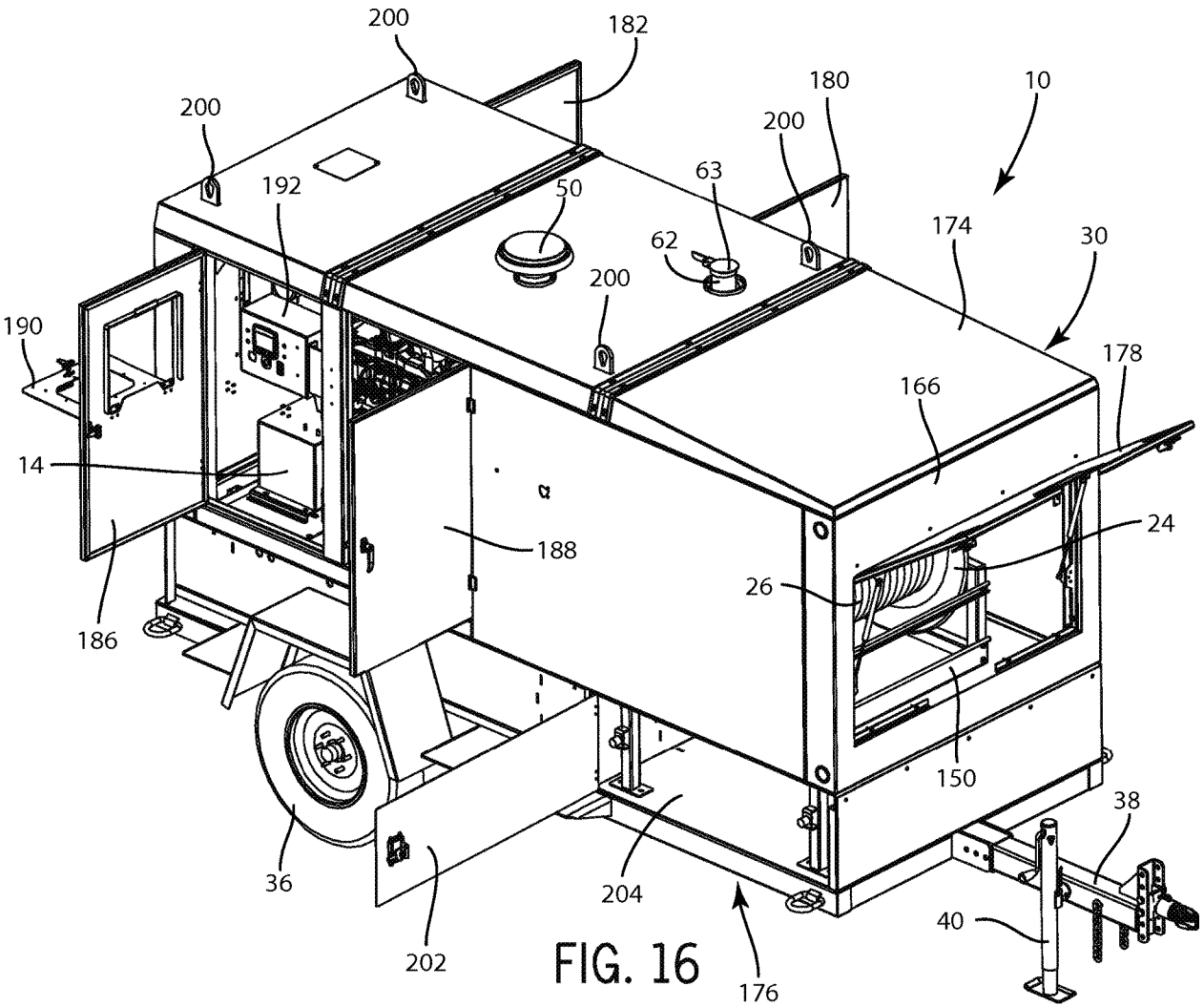
FIG. 16 is a further right-side perspective view of the heating system of FIG. 1 showing a number of access doors in an open position.

Referring now FIGS. 14-16, the aforedescribed main operating components 12, 14, 16, 18, 20, 22, 24 and 26 of the heating system 10 are located within the surrounding trailer enclosure 30 defined by a front wall 166, a left side wall 168, a right side wall 170, a rear wall 172 and atop wall 174. An understructure 176 is provided beneath the main deck 28 for storing equipment, tools and the like as well as housing a fuel tank for the engine 12.

The enclosure 30 includes a number of access and service doors which are movable between closed positions and open positions. More specifically, front wall 166 includes an access door 178 that can be opened to access the hose reel 24 and conduit arrangement 26. Left side wall 168 includes a pair of service doors 180, 182 for servicing the interior of the enclosure from the left side and rear portion thereof. Left side wall 168 also includes an air outlet 184 in communication with an external cylindrical duct 186 to which a suitably sized air hose may be removably attached. The air outlet 184 is also in communication with the blower arrangement 120, the exhaust heat exchanger 58 and an air duct 185 (FIGS. 1 and 4) located between the exhaust heat exchanger 58 and the air outlet 184. Right side wall 170 includes a pair of service doors 186, 188 for servicing the interior of the enclosure 30 from the right side and rear portion thereof. Service door 186 is provided with an access door 190 for accessing a control panel 192 (FIG. 15) mounted in the enclosure 30. Rear wall 172 includes a framework 194 housing a series of louvers 196 (FIG. 1) in alignment with an air opening 198 which is in communication with the radiator 22. The framework 194 has a handle 199 for controlling opening and closing of the louvers 196. The top wall 174 is formed with openings through which the upper ends of the air intake assembly 50 and the exhaust outlet 62 project. Top wall 174 is also provided with a series of lift elements 200 which are engageable with a lifting device, such as a crane hook, should be desirable to transport the system 10 other than by towing the wheeled trailer enclosure 30 with a vehicle. As seen in FIG. 16, the understructure 176 is provided with a service door 202 for accessing a storage compartment 204.

In use, the heating system 10 is placed at a desired location, engine 12 is started and control panel 192 is actuated so that the pump 16 will deliver heat transfer fluid, such as glycol, from reservoir 14 to the heat exchanger 18. The heat exchanger 18 removes heat from the heated engine coolant supplied from the engine water jacket, and transfers that heat to the heat transfer fluid while simultaneously enabling return of cooled engine coolant back to the water jacket. The heated transfer fluid continues to be pumped to the engine-driven heat generator 20 where it is further heated due to the fluid friction created by the rotor 131 inside the heat generator 20 as it circulates the heated transfer fluid therein.

Should it be desired, for example, to thaw frozen ground or another frozen surface or object, such as a frozen pipe, or if it is desired to cure concrete in a cold environment in a ground loop mode, the closed loop conduit arrangement 26 is unspooled from the hose arrangement 24, and positioned aver or under a surface or object to be thawed or cured, as desired. Valve 128 on heat generator 20 is then operated to transfer and circulate heated transfer fluid by means of pump 16 through the conduit arrangement 26 such that heat from the heated transfer fluid therein is radiated to the desired targeted cold environment. During this process, heat is removed from the heated transfer fluid and returned to the reservoir 14 so that the transfer fluid can again be heated.

Should it be desired to provide a temporary source of heated air in an air heat mode, the valve 128 is operated to transfer heated transfer fluid to the radiator 22 so that it radiates the heat from the heated transfer fluid to the air. The heated transfer fluid running through the radiator 22 is cooled and is returned to the reservoir 14. The fan of the blower arrangement 120 pulls the heated air from the radiator 22 across the engine 12 through the air opening 198 and the control louvers 196 at the rear of enclosure 30 along with radiant heat from the engine 12 and the exhaust pipe 56 to the housing of the blower arrangement 120. The heated air is then transferred through the exhaust heat exchanger 58 which further captures radiant heat from the exhaust pipe 56, and the air is further transferred through the air duct 185 and air outlet 184 into the external duct 186 for use as desired. Exhaust gases from the exhaust pipe 56 are safely directed from the exhaust outlet 62 outside the enclosure 30.

In some applications, the valve 128 is operated to deliver heated transfer fluid to both the radiator 22 and the conduit arrangement 26.

Accordingly, the present disclosure thus provides a self-contained mobile heating system which employs a series of heat exchangers and a heat generator to provide a heated closed loop conduit arrangement and/or a temporary source of heated air with high efficiency. Because of the flameless design of the heating system, the heat produced has little to no moisture making it ideal for different applications of heating areas, such as building construction, well sites, curing concrete, infestation control, drying flooded buildings, or drying agricultural products. No smelly or dangerous noxious fumes or exhaust gases are allowed into the heated air stream produced making the heating system safe and environmentally acceptable.

In the foregoing description, certain terms have been used for brevity, clarity, and understanding. No necessary limitations are to be implied therefrom beyond the requirements of the prior art and/or the plain meaning of the language or terms used because such language and/or terms are used for descriptive purposes only and are not intended to be broadly construed. The systems, apparatuses, and method described herein may be used alone or in combination with other systems, apparatuses, and/or methods. Various equivalents, alternatives, and modifications are possible within the scope of the appended claims. None of the limitations in the appended claims are intended to invoke interpretation under 35 USC § 112, sixth paragraph, unless the terms "means" or "step for" are explicitly recited in the respective limitation.

As will be recognized by one of skill in the art, the present application can be utilized for many heat transfer fluids. While the detailed description discusses use of propylene glycol liquid, it must be recognized that other heat transfer fluids may be transported by the disclosed apparatus and materials as recognized in the art, including, but not limited to: air, water, glycol-water mixtures, ethylene glycol, synthetic hydrocarbons, paraffin hydrocarbons, refined mineral oils, methyl alcohol, or silicones.

What is claimed is:

1. A closed loop heating system comprising:

an internal combustion engine provided with engine coolant flowing to and from the engine, and exhaust gases flowing from the engine, and heated thereby;

a reservoir having supply of heat transfer fluid;

a fluid heat exchanger in fluid communication with the heat transfer fluid of the reservoir and the engine coolant of the internal combustion engine, the fluid heat exchanger being configured to receive heated engine coolant from the internal combustion engine and to transfer heat from the engine coolant to the heat transfer fluid to provide heated transfer fluid; and a heat generator in fluid communication with the fluid heat exchanger, the heat generator being configured to directly receive the heated transfer fluid in a free flow from the fluid heat exchanger, and to circulate the heated transfer fluid within the heat generator to further heat the heated transfer fluid, wherein the heating system is configured with a control valve to allow for using the heated transfer fluid to selectively heat an extendable closed loop conduit arrangement and a volume of air without requiring any heated transfer fluid to be heated by the exhaust gases of the engine, the control valve having an inlet in fluid communication with the heat generator and having first and second outlets thereon for discharging the heated transfer fluid, the control valve inlet being configured for directly receiving the heated transfer fluid from the heat generator, wherein a first fluid delivery path including the extendable closed loop conduit arrangement provides fluid communication between the first outlet of the control valve and the reservoir, and wherein a second fluid delivery path separate from the first fluid delivery path includes a fluid to air heat exchanger and provides communication between the second outlet of the control valve and the reservoir;

wherein, in a first mode, the control valve is configured to provide the heated transfer fluid from the heat generator only to the extendable closed loop conduit arrangement, in a second mode, the control valve is configured to provide the heated transfer fluid from the heat generator only to the fluid to air heat exchanger and, in a third mode, the control valve is configured to provide the heated transfer fluid to both the extendable closed loop conduit arrangement and the fluid to air heat exchanger.

2. The heating system of claim 1, further comprising a pump for moving the heat transfer fluid from the reservoir through the fluid heat exchanger and the heat generator.

3. The heating system of claim 2, wherein the pump is driven by the internal combustion engine.

4. The heating system of claim 1, wherein the fluid heat exchanger is a shell and tube heat exchanger having a first shell for holding a supply of engine coolant, and a second shell in fluid communication with the first shell such that heat is transferred from heated engine coolant from the internal combustion engine to the heat transfer fluid from the reservoir to provide heated transfer fluid.

5. The heating system of claim 2, wherein the heat generator is in fluid communication with the fluid to air heat exchanger, and the heat generator is in further fluid communication with the extendable closed loop conduit arrangement carried by a hose reel.

6. The heating system of claim 1, wherein the heat generator includes a rotatable shaft having one end coupled to the internal combustion engine, an opposite end of the shaft drivingly coupled to a blower arrangement associated with the fluid to air heat transfer, and a rotor mounted on the shaft that circulates the heated transfer fluid within the heat generator to directly heat the heated transfer fluid from the fluid heat exchanger.

7. The heating system of claim 5, wherein an outlet of the heat generator includes the control valve in the form of a three-way valve.

8. The heating system of claim 5, wherein the fluid to air heat exchanger is a radiator.

9. The heating system of claim 7, wherein air is drawn through the fluid to air heat exchanger by a blower arrangement and to an exhaust heat exchanger in communication with an air outlet.

10. The heating system of claim 9, wherein the heat transfer fluid is circulated from the reservoir, through the pump, the fluid heat exchanger, and the heat generator along a common flow path between a supply outlet of the reservoir and the three-way control valve, and wherein the heat transfer fluid is further circulated through either the extendable closed loop conduit arrangement and back to the reservoir, through the fluid to air heat exchanger and back to the reservoir, or through both the extendable closed loop conduit arrangement and the fluid to air heat exchanger and back to the reservoir.

11. The heating system of claim 1, wherein the internal combustion engine, the reservoir, the fluid heat exchanger, and the heat generator are located on a mobile trailer provided with an enclosure, a set of ground engaging wheels and a hitching arrangement.

12. A closed loop heating system comprising:

an internal combustion engine provided with engine coolant flowing to and from the engine, and heated hereby;

a reservoir having a supply of heat transfer fluid;

a pump in fluid communication with the reservoir and configured for transferring the heat transfer fluid;

a fluid heat exchanger in fluid communication with the pump and the internal combustion engine configured to receive heated engine coolant from the internal combustion engine, and to transfer heat from the heated engine coolant to the heat transfer fluid to heat the transfer fluid and provide heated transfer fluid;

a heat generator in fluid communication with the fluid heat exchanger and configured to receive the heated transfer fluid directly in a free flow therefrom and to circulate the heated transfer fluid from the fluid heat exchanger within the heat generator to further heat the heated transfer fluid;

a control valve having an inlet in fluid communication with the heat generator, and first and second outlets configured to discharge the heated transfer fluid rescued from the heat generator, control valve inlet being configured for directly receiving the heated transfer fluid from the heat generator;

a first fluid delivery conduit arranged to provide the heated transfer fluid from the first outlet of the control valve to a hose structure having an extendable and retractable closed loop conduit arrangement configured to apply radiant heat to a surface in a ground loop mode during which the heated transfer fluid has heat removed therefrom;

a first fluid return conduit configured to return the heated transfer fluid with heat removed from the hose structure to a first inlet on the reservoir;

a second fluid delivery conduit arranged to provide the heated transfer fluid from the second outlet of the control valve to an inlet of a fluid to air heat exchanger configured to provide a source of heated air in an air heat mode during which the heated transfer fluid has heat removed; and a second fluid return conduit separate from the first fluid return conduit configured to return the heated transfer fluid with heat removed to a second inlet on the reservoir, wherein the control valve is configured to selectively control flow of the heated transfer fluid from the heat generator in a first mode to the conduit arrangement, in a second mode to the fluid to air heat exchanger, and in a third mode to both the conduit arrangement and the fluid to air heat exchanger.

13. A closed loop heating system comprising:

an internal combustion engine provided with engine coolant and exhaust gases that are heated by the engine;

a reservoir containing a supply of heat transfer fluid and having a supply outlet and a return inlet;

a pump driven by the internal combustion engine in fluid communication with the reservoir for circulating the heat transfer fluid within the system, the pump having an inlet connected to the supply outlet of the reservoir, and an outlet for discharging the heat transfer fluid therefrom;

a fluid heat exchanger in fluid communication with the pump and the internal combustion engine, the fluid heat exchanger receiving heated engine coolant from the internal combustion engine and transferring heat from the heated engine coolant to the heat transfer fluid to heat the heat transfer fluid, the fluid heat exchanger having a fluid inlet connected to the outlet of the pump, and a fluid outlet for discharging heated transfer fluid therefrom;

a heat generator driven by the internal combustion engine and in fluid communication with the fluid heat exchanger, the heat generator being configured to receive the heated transfer fluid in a free flow directly from the fluid heat exchanger, and further to circulate the heated transfer fluid within the heat generator to cause further heating of the heated transfer fluid therein, the heat generator having an inlet connected to the fluid outlet of the fluid heat exchanger, and an outlet for discharging the heated transfer fluid therefrom;

a control valve arrangement defined by a three-way control valve having an inlet connected to the outlet of the heat generator, and configured for directly receiving the heated transfer fluid from the outlet of the heat generator, and first and second outlets for discharging the heated transfer fluid received from the heat generator;

a fluid to air heat exchanger in fluid communication with the heat generator and the reservoir, the fluid to air heat exchanger configured to receive heated heat transfer fluid from the heat generator and transfer heat from the heat transfer fluid to a volume of air without requiring the heated transfer fluid to be heated by the exhaust gases of the engine, the fluid to air heat exchanger having an inlet connected to the first outlet of the three-way control valve, and an outlet connected to the return inlet of the reservoir, and an extendable closed loop conduit arrangement in fluid communication with the heat generator and the reservoir, the extendable closed loop conduit arrangement having an inlet connected to the second outlet of the three-way control valve, and an outlet connected to the return inlet of the reservoir, wherein the three-way control valve is configured to selectively control flow of the heated transfer fluid from the heat generator in one mode to the fluid to air heat exchanger, in another mode to the extendable closed loop conduit arrangement and in yet another mode, to both the fluid to air heat exchanger and the extendable closed loop conduit arrangement.

* * * * *